US006241850B1

(12) United States Patent
Kelly

(10) Patent No.: US 6,241,850 B1
(45) Date of Patent: Jun. 5, 2001

(54) SOFT TISSUE PRODUCT EXHIBITING IMPROVED LINT RESISTANCE AND PROCESS FOR MAKING

(75) Inventor: Stephen Robert Kelly, Owenton, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/334,150

(22) Filed: Jun. 16, 1999

(51) Int. Cl.[7] ..... D21C 9/00

(52) U.S. Cl. ..... 162/9; 162/100; 162/111; 162/112; 162/113; 162/125; 162/127; 162/129; 162/130; 162/158; 162/182

(58) Field of Search ..... 162/111, 100, 162/112, 113, 158, 9, 182, 125, 127, 129, 130

(56) References Cited

U.S. PATENT DOCUMENTS

| | | | |
|---|---|---|---|
| 3,414,459 | 12/1968 | Wells | 161/131 |
| 3,554,862 | 1/1971 | Hervey et al. | 162/158 |
| 3,554,863 | 1/1971 | Hervey et al. | 162/158 |
| 3,755,220 | 8/1973 | Freimark et al. | 260/17.3 |
| 3,812,000 | 5/1974 | Salvucci, Jr. et al. | 162/111 |
| 3,817,827 | 6/1974 | Benz et al. | 162/113 |
| 3,844,880 | 10/1974 | Meisel, Jr. et al. | 162/169 |
| 3,867,225 | 2/1975 | Nystrand | 156/209 |
| 3,974,025 | 8/1976 | Ayers | 162/113 |
| 3,994,771 | 11/1976 | Morgan, Jr. et al. | 162/113 |
| 4,144,122 | 3/1979 | Emanuelsson et al. | 162/158 |
| 4,191,609 | 3/1980 | Trokhan | 162/113 |
| 4,191,756 | 3/1980 | Masi et al. | 424/180 |
| 4,196,045 | 4/1980 | Ogden | 162/117 |
| 4,225,382 | 9/1980 | Kearney et al. | 162/111 |
| 4,300,981 | 11/1981 | Carstens | 162/109 |
| 4,351,699 | 9/1982 | Osborn, III | 162/112 |
| 4,425,186 | 1/1984 | May et al. | 162/158 |
| 4,432,833 | 2/1984 | Breese | 162/158 |
| 4,440,597 | 4/1984 | Wells et al. | 162/111 |
| 4,476,323 | 10/1984 | Hellsten et al. | 564/294 |
| 4,481,243 | 11/1984 | Allen | 428/154 |
| 4,488,932 | 12/1984 | Eber et al. | 162/9 |
| 4,529,480 | 7/1985 | Trokhan | 162/109 |
| 4,637,859 | 1/1987 | Trokhan | 162/109 |
| 4,795,530 | 1/1989 | Sorens et al. | 162/111 |
| 4,959,125 | 9/1990 | Spendel | 162/158 |
| 4,981,557 | 1/1991 | Bjorkquist | 162/168 |
| 5,059,282 | 10/1991 | Ampulski et al. | 162/111 |
| 5,217,576 | 6/1993 | Van Phan | 162/158 |
| 5,223,096 | 6/1993 | Phan et al. | 162/158 |
| 5,225,047 | 7/1993 | Graef et al. | 162/9 |
| 5,228,954 | 7/1993 | Vinson et al. | 162/100 |
| 5,240,562 | 8/1993 | Phan et al. | 162/158 |
| 5,262,007 | 11/1993 | Phan et al. | 162/158 |
| 5,264,082 | 11/1993 | Phan et al. | 162/158 |
| 5,279,767 | 1/1994 | Phan et al. | 252/357 |
| 5,294,475 | 3/1994 | McNeil | 428/154 |
| 5,312,522 | 5/1994 | Van Phan et al. | 162/111 |
| 5,332,118 | 7/1994 | Muckenfuhs | 221/48 |
| 5,334,289 | 8/1994 | Trokhan | 162/358.2 |
| 5,397,435 | 3/1995 | Ostendorf et al. | 162/112 |
| 5,399,240 | 3/1995 | Graef et al. | 162/9 |
| 5,399,241 | 3/1995 | Oriaran et al. | 162/112 |
| 5,415,737 | 5/1995 | Phan et al. | 162/111 |
| 5,417,753 | 5/1995 | Hutcheson | 106/199 |
| 5,494,554 | 2/1996 | Edwards et al. | 162/111 |
| 5,510,000 | 4/1996 | Phan et al. | 162/111 |
| 5,538,595 | 7/1996 | Trokhan et al. | 162/123 |
| 5,543,067 | 8/1996 | Phan et al. | 106/287.25 |
| 5,573,637 | 11/1996 | Ampulski et al. | 162/112 |
| 5,607,551 | 3/1997 | Farrington, Jr. et al. . | |
| 5,611,890 | 3/1997 | Vinson et al. | 162/111 |
| 5,624,532 | 4/1997 | Trokhan et al. | 162/111 |
| 5,690,790 | 11/1997 | Headlam et al. | 162/175 |
| 5,695,607 | 12/1997 | Oriaran et al. | 162/112 |
| 5,700,352 | 12/1997 | Vinson et al. | 162/111 |
| 5,730,839 | 3/1998 | Wendt et al. . | |
| 5,759,346 | 6/1998 | Vinson . | |
| 5,760,212 | 6/1998 | Smith | 536/123.1 |
| 5,785,813 | 7/1998 | Smith et al. . | |
| 5,830,317 | 11/1998 | Vinson et al. | 162/125 |
| 5,843,278 | 12/1998 | Goyal et al. . | |
| 5,846,380 | 12/1998 | Van Phan et al. | 162/111 |
| 5,882,479 | 3/1999 | Oriaran et al. | 162/112 |
| 5,932,068 | 8/1999 | Farrington, Jr. et al. | 162/117 |
| 5,981,044 | 11/1999 | Phan et al. | 428/212 |
| 6,017,417 | 1/2000 | Wendt et al. | 162/109 |
| 6,017,418 | 1/2000 | Oriaran et al. | 162/111 |
| 6,030,675 | 2/2000 | Schroeder et al. | 428/59 |

FOREIGN PATENT DOCUMENTS

| | | | |
|---|---|---|---|
| 944906 | 4/1974 | (CA) | 9/58 |
| 2239927 | 1/1999 | (CA) . | |
| 2239965 | 1/1999 | (CA) . | |
| 0132128 A1 | 1/1985 | (EP) | D21C/9/00 |
| 0 631 014 A1 | 12/1994 | (EP) | D21H/27/30 |
| 0 768 425 A2 | 4/1997 | (EP) | D21H/21/20 |
| 0 899 377 A2 | 3/1999 | (EP) | D21H/11/20 |
| 1 013 825 A1 | 6/2000 | (EP) | D21H/23/00 |
| WO 95/01478 | 1/1995 | (WO) | D21H/17/07 |
| WO 97/17494 | 5/1997 | (WO) . | |
| WO 98/19010 | 5/1998 | (WO) . | |
| WO 98/19012 | 5/1998 | (WO) . | |
| WO 98/19013 | 5/1998 | (WO) . | |
| WO 98/28491 | 7/1998 | (WO) . | |
| WO 99/34057 | 7/1999 | (WO) | D21H/17/00 |

*Primary Examiner*—Peter Chin
(74) *Attorney, Agent, or Firm*—Julia A. Glazer; Tara M. Rosnell

(57) ABSTRACT

A soft tissue product and method for making a soft tissue product which exhibits resistance to limiting while maintaining physical strength integrity. The process includes debonding and mechanically treating papermaking fibers, forming a tissue web and drying the tissue web. The process allows for the use of high levels of debonding agents and hardwood fibers.

20 Claims, 2 Drawing Sheets

SOFT TISSUE PRODUCT EXHIBITING IMPROVED LINT RESISTANCE AND PROCESS FOR MAKING

FIELD OF THE INVENTION

This invention relates to a soft tissue product and a method for making a soft tissue product which exhibits improved resistance to linting while maintaining physical strength integrity.

BACKGROUND OF THE INVENTION

Tissue paper products are linked by common consumer demand for a generally conflicting set of physical properties: a pleasing tactile impression (i.e.; softness) while at the same time having strength and a resistance to linting and dusting. Research and development efforts have been directed to the improvement of each of these attributes without negatively impacting the others.

Strength is the ability of the product and its constituent webs to maintain physical integrity and to resist tearing, bursting, and shredding under use conditions.

Softness is the tactile sensation perceived by the consumer as the consumer holds a particular product, rubs it across his/her skin, or crumples it within his/her hand. This tactile sensation is provided by a combination of several physical properties including the stiffness, the surface smoothness, and the lubricity of the paper web from which the product is made. Stiffness, in turn, is usually considered to be directly dependent upon the dry tensile strength of the web and the stiffness of the fibers which make up the web.

Linting and dusting refers to the tendency of a fibrous product and its constitutent web to release unbound or loosely bound fibers during handling or use. Lint resistance is the ability of the fibrous product, and its constituent web, to bind together under use conditions. In other words, the higher the lint resistance, the lower the propensity of the web to lint.

It is well known in the art that hardwood pulp fibers tend to be shorter fibers than softwood fibers. It is also well known in the art that hardwood pulp fibers tend to provide more softness and have less tensile strength than softwood pulp fibers. Additionally, it is well known that hardwood pulp fibers have more of a tendency to lint than softwood pulp fibers.

Though consumers prefer a soft tissue, transfer of lint from the tissue to the user's skin and clothing is deemed undesirable. Furthermore, a tissue, which falls apart during use by the consumer is deemed undesirable.

Hence, it would be desirable to have a tissue which is soft and exhibits resistance to lint while maintaining physical strength integrity.

U.S. Pat. No. 3,554,863 issued to Hervey et al. on Jan. 12, 1971 purports to teach a cellulose pulp sheet impregnated with a cationic long chain fatty alkyl debonding agent. Hervey et al. teaches that addition of the debonding agent reduces the tensile strength of the pulp sheet.

U.S. Pat. No. 4,144,122 issued to Emanuelson et al. on Mar. 13, 1979 purports to teach a process for treating cellulose pulp fibers to reduce interfiber bonding and impart a low degree of mechanical strength to the web formed therefrom.

In light of the prior art, one would expect to find that the addition of debonding agents to the pulp fiber increases softness while negatively impacting lint formation and the physical strength integrity of the tissue. Hence, it is unexpected to find that the present invention allows for the addition of large amounts of debonding agent to the pulp fibers to produce a soft tissue without any appreciable loss of tensile strength or increases in lint formation.

It is also unexpected to find that large amounts of debonding agent can be added to hardwood pulp to increase the softness of the tissue without a detrimental increase in lint formation and without any appreciable loss of tissue physical strength integrity. This allows for larger percentages of hardwood fibers to be utilized in the consumer contacting areas of the tissue (i.e.; outer layers and/or outer plies of the tissue).

SUMMARY OF THE INVENTION

The present invention relates to a process for making soft tissue wherein the process comprises providing an aqueous slurry of papermaking fibers. The aqueous papermaking fibers may include hardwood fibers such as but not limited to eucalyptus fibers. The aqueous slurry of papermaking fibers is debonded and mechanically treated.

The debonding agent is added to the papermaking fibers in an amount from about 13 pounds per ton to 30 pounds per ton of the debonding agent by weight of dry papermaking fibers. The papermaking fibers are mechanically treated such that the Canadian Standard Freeness after mechanical treatment is at least about 1.5% less than the Canadian Standard Freeness of the papermaking fibers prior to mechanical treatment. The papermaking fibers are then formed into a tissue web and dried.

Suitable debonding agents include but are not limited to quaternary ammonium compounds and tertiary amines. The quaternary ammonium compound may have the following formula:

$$(R_1)_{4-m}—N^+—[R_2]_mX^-$$

wherein m is 1 to 3;

each $R_1$ is a $C_1$–$C_8$ alkyl group, hydroxyalkyl group, hydrocarbyl or substituted hydrocarbyl group, alkoxylated group, benzyl group, or mixtures thereof;

each $R_2$ is a $C_9$–$C_{41}$ alkyl group, hydroxyalkyl group, hydrocarbyl or substituted hydrocarbyl group, alkoxylated group, benzyl group, or mixtures thereof; and $X^-$ is any softener-compatible anion.

The quaternary ammonium compound may be a dialkyldimethylammonium salt wherein the dialkyldimethylammonium salt is dialkyldimethylammonium chloride, ditallowdimethylammonium methyl sulfate, di(hydrogenated) tallow dimethyl ammonium chloride, or mixtures thereof.

The quaternary ammonium compound may also be a biodegradable ester-functional quaternary ammonium compound having the formula:

$$(R)_{4-m}—N^+—[(CH_2)_n—Y—R_2]_mX^-$$

wherein each Y=—O—(O)C—, or —C(O)—O—;

m=1 to 3;

each n=1 to 4;

each R substituent is a short chain $C_1$–$C_6$ alkyl group, hydroxyalkyl group, hydrocarbyl group, benzyl group or mixtures thereof; each $R_2$ is a long chain, $C_{11}$–$C_{23}$ hydrocarbyl, or substituted hydrocarbyl substituent and $X^-$ is any softener-compatible anion.

An optional wet strength agent may be added to the papermaking fibers in an amount from about 0.1 pound per ton to 60 pounds per ton by weight of the dry papermaking fibers. An optional dry strength agent may also be added to the papermaking fibers in an amount from about 0.1 pound per ton to 60 pounds per ton by weight of the dry papermaking fibers. A suitable dry strength agent for this purpose includes but is not limited to carboxymethylcellulose.

A tissue web is formed. The tissue web may be through air dried or conventionally wet pressed. The tissue web may be comprised of one or more layers. The tissue web includes at least one outer layer comprised of at least about 30% hardwood fiber. The tissue product may also be comprised of one or more plies.

The present invention also relates to a process for making soft tissue wherein the process comprises providing an aqueous slurry of hardwood papermaking fibers. The hardwood papermaking fibers are debonded with a debonding agent. The debonding agent is added to the hardwood papermaking fibers in an amount from about 13 pounds per ton to 30 pounds per ton of the debonding agent by weight of dry hardwood papermaking fibers. A tissue web is formed. The tissue web is comprised of an outer layer and an inner layer. The outer layer of the tissue web is hardwood fiber.

DETAILED DESCRIPTION OF THE INVENTION

Figure 1:
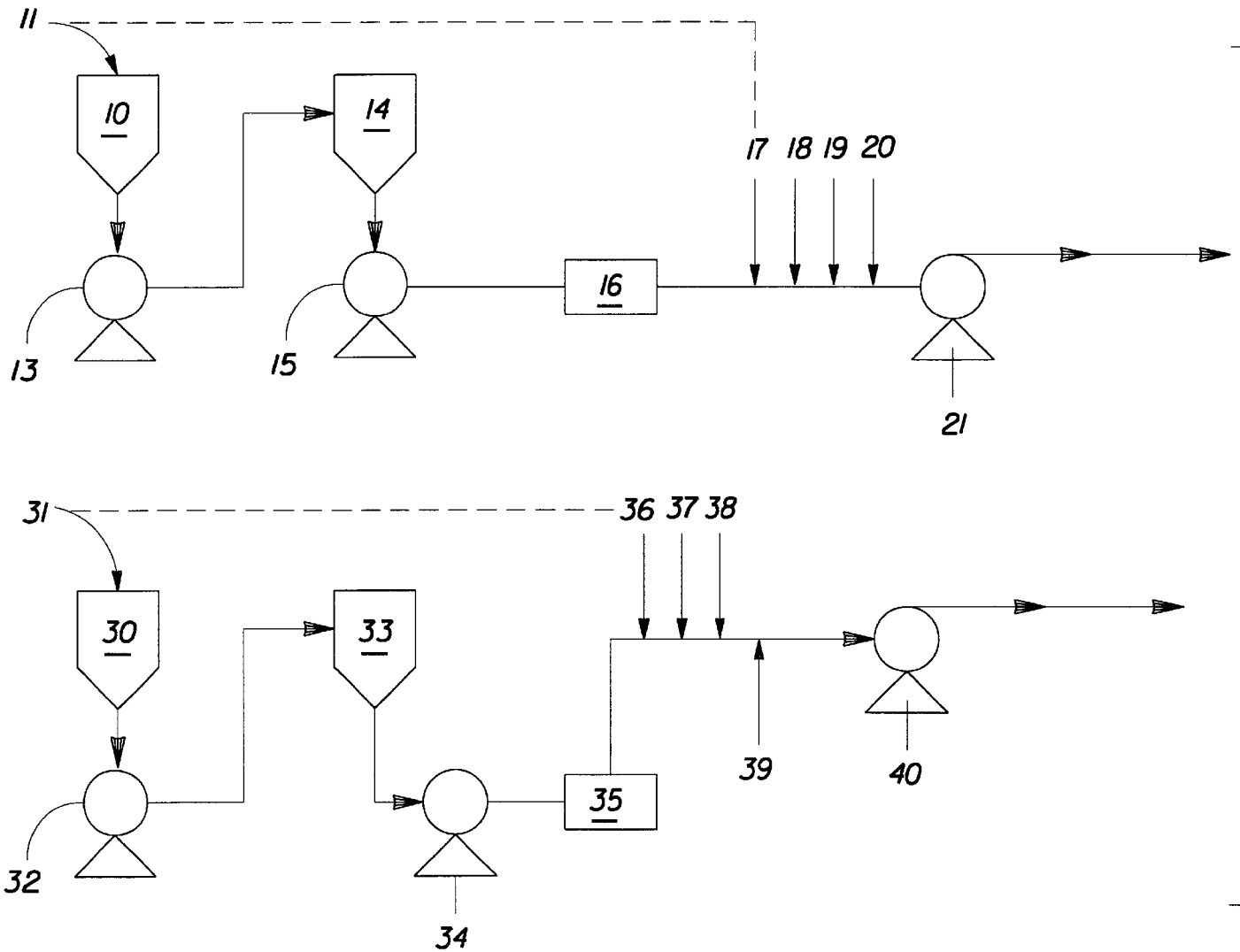
FIG. 1 is a schematic representation illustrating a suitable process for producing the aqueous papermaking furnish of the present invention.

The present invention relates to a soft tissue product which maintains physical strength integrity while exhibiting lint resistance. The invention comprises five steps: providing an aqueous slurry of papermaking fibers, debonding the papermaking fibers, mechanically treating the papermaking fibers, forming a tissue web, and drying the tissue web.

As used herein, the term "lint resistance" refers to the ability of the tissue product and its constituent webs to bind together under use conditions, including when wet. The higher the lint resistance is, the lower the propensity of the web to form lint.

As used herein, the terms "linting" and "dusting" refer to the tendency of the tissue product and its constitutent webs to release unbound or loosely bound fibers during handling or use.

As used herein, the terms "debonding" and "bond inhibiting" refer to the disruption of the natural fiber to fiber bonding that occurs during the papermaking process.

As used herein, the terms "debonder", "debonding agent", "bond inhibitor", and "bond inhibiting agents" refer to agents which act to disrupt the natural fiber to fiber bonding that occurs during the papermaking process.

As used herein, the terms "mechanically treated", "mechanical treatment" or "mechanically treating" all refer to the development of fiber tensile strength, by subjecting papermaking fibers to mechanical energy. Examples of equipment which may be used to impart mechanical energy to papermaking fibers include but are not limited to beaters and refiners.

As used herein, the terms "tissue paper web", "paper web", "web", "paper sheet", "tissue product", and "paper product" all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, with or without pressing, and by evaporation.

As used herein, an "aqueous papermaking furnish" refers to an aqueous slurry of papermaking fibers and the chemicals described hereinafter.

As used herein, the term "multi-layered tissue paper web", "multi-layered paper web", "multi-layered web", "multi-layered paper sheet", and "multi-layered paper product" all refer to sheets of paper prepared from two or more layers of aqueous papermaking furnish which are preferably comprised of different fiber types. The fibers are typically relatively long softwood and relatively short hardwood fibers as used in tissue papermaking. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "multi-ply tissue paper product" refers to a tissue paper comprised of at least two plies. Each individual ply in turn can be comprised of single-layered or multi-layered tissue paper webs. The multi-ply structures are formed by bonding together two or more tissue webs such as by gluing or embossing.

As used herein the terms "through air drying" and "blow through drying" refer to a technique of removing water from the web by drying the web with hot air.

As used herein, the terms "mechanical dewatering", "conventional wet pressing", and "conventional felt pressing" all refer to a technique of removing water from the web by mechanically pressing the web with a dewatering felt.

As used herein, the terms "outer layer", "wire side layer", "Yankee contacting layer", "consumer-contacting layer", and "opposite-side", all refer to the side of the tissue which comes into contact with the consumer.

As used herein, the terms "inner layer", "felt side layer", and "fabric-side" refer to the side of the tissue which the consumer does not contact.

The present invention is applicable to tissue paper in general, including but not limited to conventionally wet pressed tissue paper, through air dried tissue paper, high bulk pattern densified tissue paper, and high bulk, uncompacted tissue paper.

The tissue paper products of the present invention may be of a single layer or multi-layer construction.

Papermaking Components

Papermaking Fibers

It is anticipated that wood pulp in all its varieties will normally comprise the papermaking fibers used in this invention. However, other cellulose fibrous pulps, such as cotton linters, bagasse, rayon, etc., can also be used. Pulps useful herein include those derived from chemical pulping processes such as kraft, sulfite and sulfate pulps as well as those derived from mechanical pulping processes such as, groundwood, thermomechanical pulps (TMP) and chemithermomechanical pulps (CTMP). Pulp fibers derived from both deciduous and coniferous trees can be used in these pulping processes.

Synthetic fibers such as rayon, polyethylene and polypropylene fibers, may also be utilized in combination with the above-identified natural cellulose fibers. One exemplary polyethylene fiber which may be utilized is Pulpex®, available from Hercules, Inc. (Wilmington, Del.).

Both hardwood pulps and softwood pulps as well as combinations of the two may be employed. Hardwood pulps refer to fibrous pulp derived from the woody substance of deciduous trees (angiosperms). Softwood pulps refer to fibrous pulps derived from the woody substance of coniferous trees (gymnosperms). Hardwood pulps such as eucalyptus are particularly preferred for the outer layers of the multi-layered tissue webs described herein, whereas northern softwood kraft pulps are preferred for the inner layer(s) or ply(ies). Also applicable to the present invention are low cost fibers derived from recycled paper, which may contain any or all of the above categories as well as other non-fibrous materials such as fillers and additives used to facilitate the original papermaking process.

Papermaking fibers suitable for use with the present invention also include but are not limited to those disclosed in commonly assigned U.S. Pat. No. 5,830,317 issued to Vinson et al. on Nov. 3, 1998 the disclosure of which is incorporated herein by reference.

The tissue paper of the present invention may be layered. If the tissue is layered, a multi-channel headbox may be used. Such a headbox may have two, three, or more channels. Each channel may be provided with a different fiber slurry. Optionally, the same slurry may be provided in two or more of the channels.

Typically, the paper is layered so that shorter hardwood fibers are on the outside to provide a soft tactile sensation to the user. Longer softwood fibers are on the inside for strength. Thus, a three-channel headbox may produce a single-ply tissue product, having two outer layers comprising predominantly hardwood fibers and a central layer comprising predominantly hardwood fibers.

Alternatively, a two-channel headbox may produce a single-ply tissue product, having one layer comprising predominantly softwood fibers and one layer comprising predominantly hardwood fibers. Such a ply is joined to another ply of a like tissue paper, so that the softwood layers of the resulting two-ply laminate are inwardly oriented toward each other and the hardwood layers are outwardly facing.

Joining the plies may be accomplished by techniques including but not limited to ply bonding as disclosed in commonly assigned U.S. Pat. Nos. 4,481,243 issued to Allen on Nov. 6, 1984; U.S. Pat. No. 5,294,475 issued to McNeil on Mar. 15, 1994; U.S. Pat. No. 3,414,459 issued to Wells on Dec. 3, 1968, or U.S. Pat. No. 3,867,225 issued to Nystrand on Feb. 18, 1975, the disclosures of which are incorporated herein by reference.

The tissue of this invention is not limited to only single ply or two ply embodiments, but can also include embodiments utilizing more than two plies.

In an alternative manufacturing technique, multiple headboxes may be utilized in place of a single headbox having multiple channels. In the multiple headbox arrangement, the first headbox deposits a discrete layer of cellulosic fibers onto the forming wire. The second headbox deposits a second layer of cellulosic fibers onto the first. While, of course, some intermingling between the layers occurs, a predominantly layered tissue paper results.

Layered tissue paper may be made according to the teachings of commonly assigned U.S. Pat. No. 3,994,771, issued to Morgan, Jr. et al. on Nov. 30, 1976; U.S. Pat. No. 4,225,382, issued to Kearney et al. on Sep. 30, 1980; and U.S. Pat. No. 4,300,981, issued to Carstens on Nov. 17, 1981, the disclosures of which are incorporated herein by reference.

A preferred embodiment of the present invention comprises a layered tissue web wherein, most preferably, a hardwood fiber(s) such as eucalyptus is used for the outer layer(s) and wherein a softwood fiber(s) such as northern softwood kraft is used for the inner layer(s).

The outer layer(s) of the tissue web is comprised of at least about 30% hardwood fiber, preferably at least about 50% hardwood fiber, more preferably at least about 70% hardwood fiber, and most preferably about 100% hardwood fiber.

The tissue web has a basis weight of about 5 pounds to 80 pounds per 3000 square feet, preferably about 6 pounds to 70 pounds per 3000 square feet, more preferably about 7 pounds to 60 pounds per 3000 square feet, and most preferably 8 pounds to 50 pounds per 3000 square feet.

Debonding/Bond Inhibiting Agents

Debonding agents suitable for use with this invention include but are not limited to those disclosed in commonly assigned U.S. Pat. No. 5,217,576 issued to Van Phan on Jun. 8, 1993; U.S. Pat. No. 5,223,096 issued to Phan et al. on Jun. 29, 1993; U.S. Pat. No. 5,240,562 issued to Phan et al. on Aug. 31, 1993; U.S. Pat. No. 5,279,767 issued to Phan et al. on Jan. 18, 1994; U.S. Pat. No. 5,415,737 issued to Phan et al. on May 16, 1995; U.S. Pat. No. 5,538,595 issued to Trokhan et al., on Jul. 23, 1996; U.S. Pat. No. 5,510,000 issued to Phan et al. on Apr. 23, 1996; U.S. Pat. No. 5,543,067 issued to Phan et al. on Aug. 6, 1996; U.S. Pat. No. 5,830,317 issued to Vinson et al. on Nov. 3, 1998; and U.S. Pat. No. 5,846,380 issued to Van Phan et al. on Dec. 8, 1998 the disclosures of which are incorporated herein by reference.

Other debonding agents suitable for use with this invention include those disclosed in U.S. Pat. No. 5,399,241 issued to Oriaran et al. on Mar. 21, 1995 and U.S. Pat. No. 5,882,479 issued to Oriaran et al. on Mar. 16, 1999, the disclosures of which are incorporated herein by reference for the limited purpose of illustrating materials which may be used as debonding agents.

Suitable debonding agents include biodegradable ester-functional quaternary ammonium compounds such as those having the formula:

$$(R)_{4-m}—N^{+}—[(CH_2)_n—Y—R_2]_m X^{-}$$

wherein each Y=—O—(O)C—, or —C(O)—O—;

m=1 to 3; preferably, m=2;

each n=1 to 4; preferably, n=2;

each R substituent is a short chain $C_1$–$C_6$, preferably $C_1$–$C_3$, alkyl group, e.g., methyl (most preferred), ethyl, propyl, and the like, hydroxyalkyl group, hydrocarbyl group, benzyl group or mixtures thereof; each $R_2$ is a long chain, preferably at least partially unsaturated (IV of greater than about 5 to less than about 100, more preferably from about 10 to about 85), $C_{11}$–$C_{23}$ hydrocarbyl, or substituted hydrocarbyl substituent and the counter-ion, $X^-$, can be any softener-compatible anion, for example, acetate, chloride, bromide, methylsulfate, formate, sulfate, nitrate and the like.

Preferably, the majority of $R_2$ comprises fatty acyls containing at least 90% $C_{18}$–$C_{24}$ chain length. More preferably, the majority of $R_2$ is selected from the $C_{18}$–$C_{24}$ fatty acyls derived from vegetable oils.

Specific examples of ester-functional quaternary ammonium compounds suitable for use in the present invention include but are not limited to the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated)tallow dimethyl ammonium methyl sulfate, diester di(hydrogenated)tallow dimethyl ammonium chloride, and mixtures thereof. Diester ditallow dimethyl ammonium chloride and diester di(hydrogenated) tallow dimethyl ammonium chloride are particularly preferred. The diester ditallow dimethyl ammonium chloride and diester di(hydrogenated)tallow dimethyl ammonium chloride are available commercially from Witco Chemical Company Inc. of Dublin, Ohio under the tradename ADOGEN SDMC.

Suitable debonding agents also include those quaternary ammonium compounds having the formula:

$$(R_1)_{4-m}—N^+—[R_2]_mX^-$$

wherein m is 1 to 3;

each $R_1$ is a $C_1$–$C_8$ alkyl group, hydroxyalkyl group, hydrocarbyl or substituted hydrocarbyl group, alkoxylated group, benzyl group, or mixtures thereof;

each $R_2$ is a $C_9$–$C_{41}$ alkyl group, hydroxyalkyl group, hydrocarbyl or substituted hydrocarbyl group, alkoxylated group, benzyl group, or mixtures thereof; and $X^-$ is any softener-compatible anion.

Preferably, the majority of $R_2$ comprises fatty acyls containing at least 90% $C_{18}$–$C_{24}$ chain length. More preferably, the majority of $R_2$ is selected from the $C_{18}$–$C_{24}$ fatty acyls derived from vegetable oils.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. Preferably, each $R_2$ is $C_{16}$–$C_{18}$ alkyl, most preferably each $R_2$ is straight-chain $C_{18}$ alkyl. Preferably, each $R_1$ is methyl and $X^-$ is chloride or methyl sulfate. Optionally, the $R_2$ substituent can be derived from vegetable oil sources.

Examples of quaternary ammonium compounds suitable for the present invention include the dialkyldimethylammonium salts. Preferred dialkyldimethylammonium salts include ditallowdimethylammonium chloride, di(hydrogenated tallow) dimethyl ammonium chloride, and most preferably ditallowdimethylammonium methyl sulfate.

A suitable ditallowdimethylammonium methyl sulfate is VARISOFT 137® commercially available from Witco Chemical Company Inc. of Dublin, Ohio.

The use of quaternary ammonium ingredients as described herein above is most effectively accomplished if the quaternary ammonium ingredient is accompanied by an appropriate plasticizer. The term plasticizer as used herein refers to an ingredient capable of reducing the melting point and viscosity at a given temperature of a quaternary ammonium ingredient. The plasticizer can be added during the quaternizing step in the manufacture of the quaternary ammonium ingredient or it can be added subsequent to the quaternization but prior to the application as a softening active ingredient. The plasticizer is characterized by being substantially inert during the chemical synthesis of the quaterrauy ammonium compound where it can act as a viscosity reducer to aid in the synthesis. Preferred plasticizers are non-volatile polyhydroxy compounds. Preferred polyhydroxy compounds include glycerol and polyethylene glycols having a molecular weight of from about 200 to about 2000, with polyethylene glycol having a molecular weight of from about 200 to about 600 being particularly preferred. When such plasticizers are added during manufacture of the quaternary ammonium ingredient, they comprise between about 5% and about 75% percent of the product of such manufacture. Particularly preferred mixtures comprise between about 15% and about 50% plasticizer.

The debonding agent is added to the papermaking fibers in an amount from about 13 pounds per ton to 30 pounds per ton of the debonding agent by weight of dry papermaking fibers and preferably from about 14 pounds per ton to 20 pounds per ton of the debonding agent by weight of the dry papermaking fibers. The debonding agent may be added to the papermaking fibers at any point in the papermaking process but is preferably added to the papermaking fibers at any suitable point prior to formation of the tissue web on the paper machine.

The papermaking fibers may be mechanically treated either prior to or after addition of the debonding agent. The papermaking fibers are mechanically treated such that the Canadian Standard Freeness (CSF) after mechanical treatment is about 1.5% less than the Canadian Standard Freeness prior to mechanical treatment, preferably about 3.5% less than the Canadian Standard Freeness prior to mechanical treatment, and more preferably about 5% less than the Canadian Standard Freeness prior to mechanical treatment.

Suitable methods of mechanically treating the fiber include but are not limited to beating and preferably refining. A suitable refiner for this purpose is the Sprout Waldron 12" Pressurized Refiner, model No. R12M, commercially available from Sprout Waldron Incorporated, a division of Kopper Company Incorporated of Muncy, Pa.

Optional Papermaking Additives

Other papermaking additives may be optionally added to the papermaking furnish or the web to impart characteristics which improve the papermaking process (process additives) or the product (functional additives). These optional additives include but are not limited to strength additives such as wet strength agents (both permanent and temporary), dry strength agents; retention aids; absorbency aids; and creping aids. Suitable optional papermaking additives include those disclosed in commonly assigned U.S. Pat. No. 5,846,380 issued to Van Phan et al. on Dec. 8, 1998 the disclosure of which is incorporated herein by reference. Another suitable optional papermaking additive is polysiloxane such as that disclosed in commonly assigned U.S. Pat. No. 5,059,282 issued to Ampulski et al. on Oct. 22, 1991 the disclosure of which is incorporated herein by reference.

Wet Strength Agents

The present invention may contain a wet strength agent(s) as an optional component. Suitable permanent wet strength agents include polyamide- epichlorohydrins, polyacrylamides, styrene-butadiene latexes, insolubilized polyvinyl alcohol, urea formaldehyde, melamine formaldehyde, polyethyleneimine, chitosan polymers and mixtures thereof Polyamide-epichlorohydrins and polyacrylamides are preferred.

A suitable polyamide-epichlorohydrin is KYMENE® 557H commercially available from Hercules, Incorporated of Wilmington, Del. A suitable polyacrylamide is PAREZ® 631 NC commercially available from Cytec Industries of Stamford, Conn.

Suitable temporary wet strength agents include but are not limited to the modified starch sold as NATIONAL STARCH 78-0080 commercially available from National Starch and Chemical Corporation of New York, N.Y. Preferred temporary wet strength resins include those disclosed in commonly assigned U.S. Pat. No. : 4,981,557 issued to Bjorkquist on Jan. 1, 1991; U.S. Pat. No. 5,690,790 issued to Headlam et al. on Nov. 25, 1997; and U.S. Pat. No. 5,760,212 issued to Smith on Jun. 2, 1998; the disclosures of which are incorporated herein by reference.

The optional wet strength agent(s) is added to the papermaking fibers in an amount from about 0.1 pound per ton to 60 pounds per ton by weight of the dry papermaking fibers, preferably from about 0.5 pound per ton to 30 pounds per ton by weight of the dry papermaking fibers, and most preferably from about 1 pound per ton to 15 pounds per ton by weight of the dry papermaking fibers.

Dry Strength Agents

The present invention may contain a dry strength agent(s) as an optional component. Suitable dry strength agents include but are not limited to polyacrylamides, starch, polyvinyl alcohol, guar or locust bean gums, carboxymethyl cellulose and mixtures thereof.

Suitable polyacrylamides include CYPRO® 514, ACCOSTRENGTH® 711, and mixtures thereof. Both CYPRO® 514 and ACCOSTRENGTH® 711 are commercially available from Cytec Industries of Stamford, Conn.

Suitable starches include REDIBOND® 5320 AND REDIBOND® 2005 both of which are commercially available from National Starch and Chemical Corporation of New York, N.Y.

A suitable polyvinyl alcohol is AIRVOL® 540 commercially available from Air Products Incorporated of Allentown, Pa.

A suitable carboxymethyl cellulose is AQUALON 7 MT available from Hercules Incorporated of Wilmington, Del.

The optional dry strength agent(s) is added to the papermaking fibers in an amount from about 0.1 pound per ton to 60 pounds per ton by weight of the dry papermaking fibers, preferably from about 0.5 pound per ton to 30 pounds per ton by weight of the dry papermaking fibers, and most preferably from about 1 pound per ton to 15 pounds per ton by weight of the dry papermaking fibers.

The Papermaking Process

The aqueous papermaking furnish and the tissue web of this invention may be made according to commonly assigned U.S. Pat. No. : 4,191,609 issued to Trokhan on issued Mar. 4, 1980; U.S. Pat. No. 4,300,981 issued to Carstens on Nov. 17, 1981; U.S. Pat. No. 4,637,859 issued to Trokhan on Jan. 20, 1987; U.S. Pat. No. 5,332,118 issued to Muckenfuhs on Jul. 26, 1994; U.S. Pat. No. 5,334,289 issued to Trokhan et al. on Aug. 2, 1994; U.S. Pat. No. 5,830,317 issued to Vinson et al. on Nov. 3, 1998; or U.S. Ser. No. 08/996,392 filed Dec. 22, 1997, the disclosures of which are incorporated herein by reference for the purpose of showing how to make aqueous papermaking furnishes and tissue webs suitable for use with the present invention.

The tissue of this invention may be conventionally wet pressed or through air dried. It may be foreshortened by creping or by other means such as wet microcontraction. Creping and wet microcontraction are disclosed in commonly assigned U.S. Pat. No. 4,191,756 issued to Sawdai on May 4, 1980 and U.S. Pat. No. 4,440,597 issued to Wells et al. on Apr. 3, 1984, the disclosures of which are incorporated herein by reference.

Though the principle use of this invention is in connection with facial tissues the invention is also applicable to other fibrous products including but not limited to bath tissue, table napkins, toweling, wipes, and cotton pads.

Components of the aqueous papermaking furnish (i.e.; aqueous slurry of papermaking fibers, etc.) can be readily formed or prepared by mixing techniques and equipment well known to those skilled in the papermaking art.

Referring to FIG. 1, an aqueous slurry of relatively long papermaking fibers is blended in mix tank 10. An optional debonding agent may be conveyed to the aqueous slurry from additive pipe 11 and/or from additive pipe 17. The slurry is then transported through pump 13 to storage tank 14. From storage tank 14 the slurry is conveyed through pump 15 and optionally through refiner 16. An optional wet strength agent is added through additive pipe 18. An optional dry strength agent is added through additive pipe 19. Dilution water is added to the aqueous slurry through dilution line 20. The aqueous slurry is then conveyed through fan pump 21.

Still referring to FIG. 1, an aqueous slurry of short papermaking fibers is blended in mix tank 30. A debonding agent is conveyed to the aqueous slurry from additive pipe 31 and/or from additive pipe 36. The slurry is then transported through pump 32 to storage tank 33. From storage tank 33 the slurry is then transported through pump 34 to refiner 35. An optional wet strength agent is added to the slurry through additive pipe 37. An optional dry strength agent is added to the slurry through additive pipe 38. Dilution water is added to the slurry through dilution line 39. The aqueous slurry of short papermaking fibers is then conveyed through fan pump 40.

A paper machine and process suitable for making the tissue web of this invention is disclosed in commonly assigned patent application U.S. Ser. No. 08/996,392 the disclosure of which is incorporated herein by reference.

Figure 2:
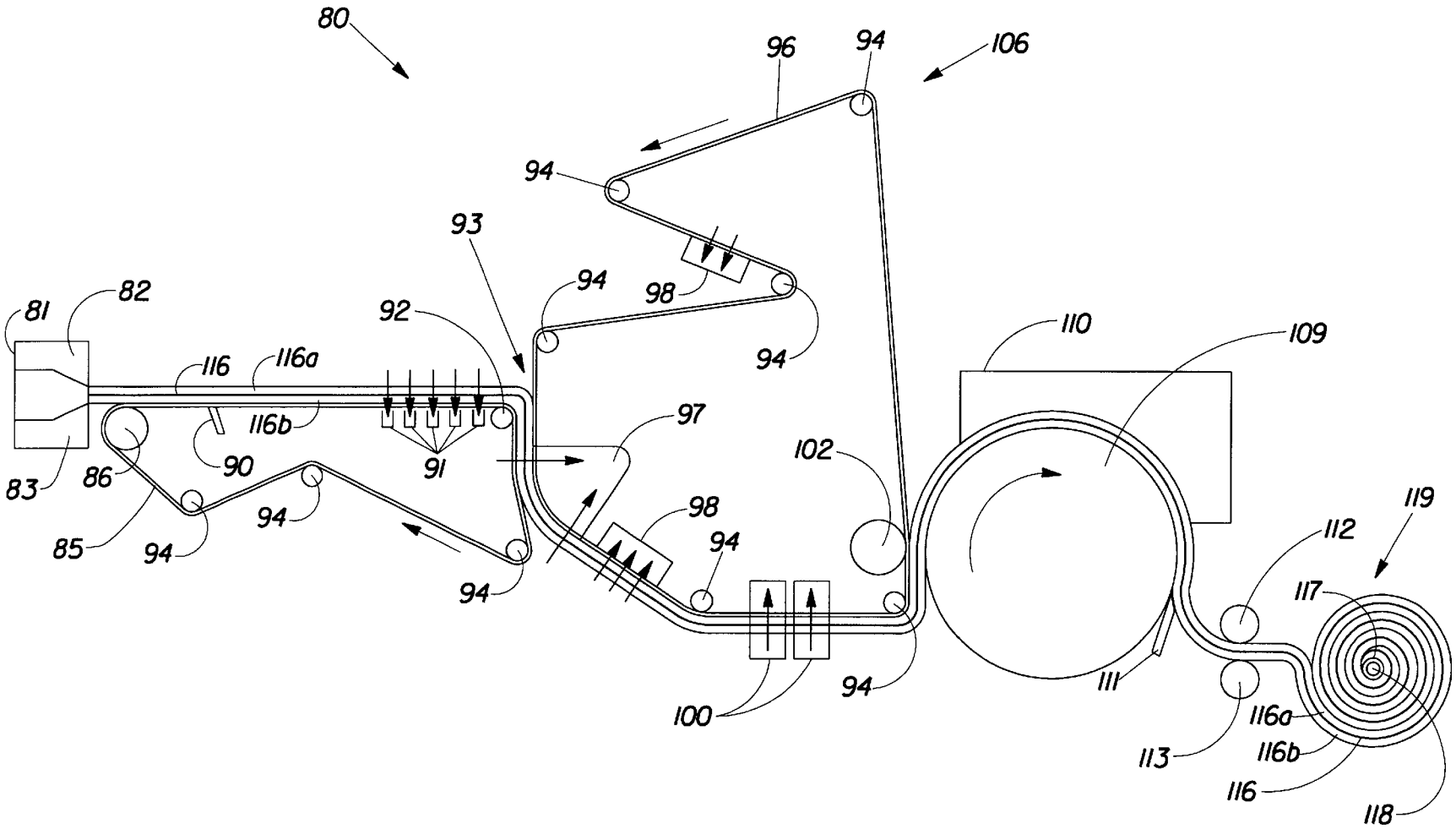
FIG. 2 is a schematic side elevational view of a papermaking apparatus suitable for producing the tissue of the present invention.

Referring to FIG. 2, the aqueous slurries of long papermaking fibers and short papermaking fibers are directed to the layering headbox 81 of paper machine 80. Long papermaking fiber may be blended with short papermaking fiber in either or both top chamber 82 and bottom chamber 83. Preferably, the aqueous slurry of long papermaking fiber is directed to top chamber 82 of layering headbox 81 and the aqueous slurry of short papermaking fiber is directed to bottom chamber 83 of layering headbox 81. The aqueous slurries of top chamber 82 and bottom chamber 83 are pumped onto forming fabric 85 wherein the two slurries combine to form tissue web 116 having inner layer 116*a* and outer layer 116*b*. Tissue web 116 is dewatered on forming fabric 85 assisted by breast roll 86, deflector 90, vacuum suction boxes 91 and couch roll 92.

Still referring to FIG. 2, tissue web 116 is then transferred to pre-drying section 106. As tissue web 116 enters web transfer zone 93, it is transferred to foraminous carrier fabric 96 by the action of vacuum transfer box 97. Foraminous carrier fabric 96 carries tissue web 116 from transfer zone 93 over vacuum box 98 into through air dryers 100 and past a turning roll 94. Tissue web 116 is transferred from foraminous carrier fabric 96 to Yankee dryer 109 wherein tissue web 116 is secured to the surface of Yankee dryer 109 by pressure roll 102. Tissue web 116 is dried by Yankee dryer 109 which is heated by steam and by hot air which is circulated through drying hood 110.

Tissue web 116 is removed from the surface of Yankee dryer 109 with creping blade 111. Tissue web 116 then passes between calender rolls 112 and 113 to reel 119 where it is wound into a roll on core 117 and disposed on shaft 118.

One of skill in the art will understand that the present invention is applicable to both creped and uncreped tissue. It also includes but is not limited to tissue webs formed on Fourdrinier paper machines and tissue webs formed on twin wire formers. Additionally, it also includes but is not limited to tissue which is through air dried and tissue which is conventionally wet pressed.

Analytical and Testing Procedures

A. Density

The density of multi-layered tissue paper, as that term is used herein, is the average density calculated as the basis weight of that paper divided by the caliper, with the appropriate unit conversions incorporated therein. Caliper of the multi-layered tissue paper, as used herein is the thickness of the paper when subjected to a compressive load of 95 g/in$^2$. Density is measured according to the procedure disclosed in commonly assigned U.S. Pat. No. 5,846,380 issued to Van Phan et al. on Dec. 8, 1998 the disclosure of which is incorporated herein by reference.

B. Tissue Tensile Strength

The tensile strength is determined on one inch wide strips of sample using a Thwing-Albert Intelect II Standard Tensile Tester (Thwing-Albert Instrument Co., 10960 Dutton Rd., Philadelphia, Pa., 19154). This method is intended for use on finished paper products, reel samples, and unconverted stocks.

Sample Conditioning and Preparation

Prior to tensile testing, the paper samples to be tested should be conditioned according to Tappi Method #T402OM-88. All plastic and paper board packaging materials must be carefully removed from the paper samples prior to testing. The paper samples should be conditioned for at least 2 hours at a relative humidity of 48 to 52% and within a temperature range of 22 to 24° C. Sample preparation and all aspects of the tensile testing should also take place within the confines of the constant temperature and humidity room.

For finished product, discard any damaged product. Next, remove eight usable units (also termed sheets) and form two stacks each containing four tissues in each stack. Identify stack 1 for machine direction tensile measurements and stack 2 for cross direction tensile measurements.

Using a paper cutter (JDC-1-10 or JDC-1-12 with safety shield from the Thwing-Albert Instrument Co., 10960 Dutton Road, Philadelphia, Pa., 19154), cut four 1" wide strips in the machine direction from stack 1. Cut four 1" wide strips in the cross direction from stack 2. There are now four 1" wide strips for machine direction tensile testing and four 1" wide strips for cross direction tensile testing.

For unconverted stock and/or reel samples, cut a 15" by 15" sample which is 2 plies thick from a region of interest of the sample using a paper cutter (JDC-1-10 or JDC-1-12 with safety shield from Thwing-Albert Instrument Co., 10960 Dutton Road, Philadelphia, Pa., 19154). Make sure one 15" cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15" by 15" sample which is 2 plies thick, cut four strips 1" by 7" with the long 7" dimension running parallel to the machine direction. Note these samples as machine direction reel or unconverted stock samples. Cut an additional four strips 1" by 7" with the long 7" dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co., 10960 Dutton Road, Philadelphia, Pa., 19154). There are now a total of eight samples: four 1" by 7" strips which are 2 plies thick with the 7" dimension running parallel to the machine direction and four 1" by 7" strips which are 2 plies thick with the 7" dimension running parallel to the cross direction.

Operation of Tensile Tester

For the actual measurement of the tensile strength, use a Thwing-Albert Intelect II Standard Tensile Tester (Thwing-Albert Instrument Co., 10960 Dutton Rd., Philadelphia, Pa., 19154). Insert the flat face clamps into the unit and calibrate the tester according to the instructions given in the operation manual of the Thwing-Albert Intelect II. Set the instrument crosshead speed to 6.00 in/min and the 1st and 2nd gauge lengths to 4.00 inches. The break sensitivity should be set to 20.0 grams and the sample width should be set to 1.00" and the sample thickness at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

Calculations

For the four machine direction 1" wide finished product strips, sum the four individual recorded tensile readings. Divide this sum by the number of strips tested. This number should normally be four. Also divide the sum of recorded tensiles by the number of usable units per tensile strip. The number of usable units per tensile strip is normally one for facial tissue. Repeat this calculation for the cross direction finished product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally one for facial tissue. Repeat this calculation for the cross direction unconverted or reel sample paper strips. All results are in units of grams/inch.

C. Measurement of Panel Softness of Tissue Papers

Ideally, prior to softness testing, the paper samples to be tested should be conditioned according to Tappi Method #T402OM-88. Here, samples are preconditioned for 24 hours at a relative humidity level of 10% to 35% and within a temperature range of 22° C. to 40° C. After this preconditioning step, samples should be conditioned for 24 hours at a relative humidity of 48% to 52% and within a temperature range of 22° C. to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero-base standard. The number of panel tests performed and averaged is such that about 0.2 PSU represents a significant difference in subjectively perceived softness.

D. Measurement of Tissue Lint

The amount of lint generated from a tissue product is determined with a Sutherland Rub Tester. This tester uses a motor to rub a weighted felt 5 times over the stationary tissue. The Hunter Color L value is measured before and after the rub test. The difference between these two Hunter Color L values is calculated as lint.

Sample Preparation

Prior to the lint rub testing, the paper samples to be tested should be conditioned according to Tappi Method #T402OM-88. Here, samples are preconditioned for 24 hours at a relative humidity level of 10% to 35% and within a temperature range of 22° C. to 40° C. After this preconditioning step, samples should be conditioned for 24° C. hours at a relative humidity of 48% to 52% and within a temperature range of 22° C. to 24° C. This rub testing should also take place within the confines of the constant temperature and humidity room.

The Sutherland Rub Tester may be obtained from Testing Machines, Inc. (Amityville, N.Y., 11701). Cut the facial tissue sample such that the resulting cross direction (CD) dimension is 4.5 inches and the machine direction (MD) dimension is the full length of the tissue.

Obtain a 30"×40" piece of CRESCENT #300 cardboard from Cordage Incorporated (800 E. Ross Road, Cincinnati, Ohio, 45217). Using a paper cutter, cut out three pieces of cardboard to dimensions of 2.5"×6". Puncture two holes into each of the three cards by forcing the cardboard onto the hold down pins of the Sutherland Rub tester.

Center and carefully place one of the 2.5"×6" cardboard pieces on top of the tissue sample. Make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape. A suitable adhesive tape is ¾" wide SCOTCH Brand adhesive tape commercially available from 3M Corporation of St. Paul, Minn. Carefully grasp the other over-hanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, discard and make up a new sample with a new tissue sample strip. There will now be 3 samples on cardboard.

Felt Preparation

Obtain a 30"×40" piece of CRESCENT #300 cardboard from Cordage Incorporated (800 E. Ross Road, Cincinnati, Ohio, 45217). Using a paper cutter, cut out pieces of cardboard to dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the black felt (F-55 or equivalent from New England Gasket, 550 Broad Street, Bristol, Conn. 06010) to the dimensions of 2.25"×8.5"×0.0625." Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with SCOTCH brand tape. Prepare enough of these felt/cardboard combinations to run, at least, three replicates of each sample.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. Discard any product which might have been damaged or abraded. Next, obtain 48 strips of tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "F." Mark the next highest number with the letter "O." Continue marking the samples in this alternating "F"/"O" pattern. Use the "F" samples for fabric-side surface "out" lint analyses and the "O" samples for opposite-side surface "out" lint analyses. There are now a total of 24 samples for the new lot of felt and the old lot of felt. Of this 24, twelve are for fabric-side surface "out" lint analysis and 12 are for opposites-side surface "out" lint analysis.

Rub and measure the Hunter Color L values for all 24 samples of the old felt as described below. Record the 12 fabric-side surface Hunter Color L values for the old felt. Average the 12 values. Record the 12 opposite-side surface Hunter Color L values for the old felt. Average the 12 values. Subtract the average initial un-rubbed Hunter Color L felt reading from the average Hunter Color L reading for the fabric-side surface rubbed samples. This is the delta average difference for the fabric-side surface samples. Subtract the average initial un-rubbed Hunter Color L felt reading from the average Hunter Color L reading for the opposite-side surface rubbed samples. This is the delta average difference for the opposite-side surface samples. Calculate the sum of the delta average difference for the fabric-side surface and the delta average difference for the opposite-side surface and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 fabric-side surface Hunter Color L values for the new felt. Average the 12 values. Record the 12 opposite-side surface Hunter Color L values for the new felt. Average the 12 values. Subtract the average initial un-rubbed Hunter Color L felt reading from the average Hunter Color L reading for the fabric-side surface rubbed samples. This is the delta average difference for the fabric-side surface samples. Subtract the average initial un-rubbed Hunter Color L felt reading from the average Hunter Color L reading for the opposite-side surface rubbed samples. This is the delta average difference for the opposite-side surface samples. Calculate the sum of the delta average difference for the fabric-side surface and the delta average difference for the opposite-side surface and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Incorporated, Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the staring and stopping point of the felt covered weight. Recalibrate when necessary.

Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

Measurement of Samples

The first step in the measurement of lint is to measure the Hunter color values of the black felt/cardboard samples prior to being rubbed on the tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual facial tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over the sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felt strips are not used again. Cardboards are used until they are bent, torn, limp, or no longer have a smooth surface.

Calculations

Determine the delta L values by subtracting the average initial L reading found for the unused felts from each of the measured values for the outer layer surface of the facial tissue samples. Calculate the average delta L for the three outer layer surface values. Subtract the felt correction factor from the calculated average delta. This value is recorded as the outer layer surface lint number.

EXAMPLES

The following examples are for illustrative purposes and are intended to aid in the description of the present invention. They should not be interpreted as a limitation on the concept of this invention. Each example refers to a test condition in Table I or Table II. Referring to Table I or Table II, columns 1 and 15 identify the test condition number. Column 2 indicates the fiber composition of a single ply of the tissue made according to the test condition. Column 3 refers to the approximate Canadian Standard Freeness ("CSF") of the eucalyptus pulp ("EUC") prior to refining. Column 4 refers to the approximate Canadian Standard Freeness of the eucalyptus pulp after refining. Column 5 refers to the amount of debonding agent added to the eucalyptus pulp. Column 6 indicates the location in the process where the debonding agent was added to the eucalyptus pulp.

Columns 7 and 11 indicate the amount of wet strength agent added respectively to the eucalyptus pulp and the northern softwood kraft pulp ("NSK"). Columns 8 and 12 indicate the location in the process where the wet strength agent was added respectively to the eucalyptus pulp and the NSK pulp. Columns 9 and 13 refer to the amount of dry strength agent added respectively to the eucalyptus pulp and the NSK. Columns 10 and 14 refer to the location in the process where the dry strength agent was added respectively to the eucalyptus pulp and the NSK pulp.

Column 16 indicates the number of plies per tissue for each test condition. Column 17 indicates the number of layers per ply per tissue for each test condition. Column 18 indicates the approximate average tensile strength of the tissue made according to the test condition. Column 19 indicates the average softness value for the tissue made according to the test condition. Column 20 indicates the average wire side/outer layer lint value for the tissue made according to the test condition. For columns 18 and 20, "N" refers to the number of tissues that were tested. For column 19, "N" refers to the number of softness panel tests conducted.

For those examples described below in which a debonding agent was utilized, the debonding agent was made according to the following procedure:

Procedure for Making Debonding Agent

A debonding agent was made according to Example 1 of commonly assigned U.S. Pat. No. 5,279,767 issued to Phan et al. on Jan. 18, 1994 the disclosure of which is incorporated herein by reference. The debonding agent was prepared according to the following procedure:

An equivalent weight of di(hydrogenated)tallow dimethyl ammonium methyl Sulfate ("DTDMAMS") (i.e.; VARISOFT 137® commercially available from Witco Chemical Company Incorporated of Dublin, Ohio) and polyethylene glycol having a weight average molecular weight of 400 ("PEG") (i.e.; PEG-400 commercially available from Union Carbide Company of Danbury, Conn.) was weighed separately. PEG was heated up to about 66° C. (150° F.). DTDMAMS was dissolved in PEG to form a melted solution at 66° C. (150° F.). Shear stress was applied to form a homogeneous mixture of DTDMAMS in PEG. Dilution water was heated up to 66° C. (150° F.). The melted mixture of DTDMAMS and PEG was diluted to a 1% solution. Shear stress was applied to form an aqueous solution containing a vesicle dispersion or suspension of the DTDMAMS/PEG mixture.

Example I

Example I depicts a process for producing a conventionally made facial tissue which does not incorporate the features of the present invention. Example I is represented by Tissue No. 1 (control tissue), in row 1 of Table I below.

Northern softwood kraft fiber ("NSK") and water were added to a mix tank to form an aqueous slurry comprised of about 3% NSK by weight of dry NSK fiber.

A wet strength agent (i.e.; KYMENE® 557H commercially available from Hercules Incorporated of Wilmington, Del.) was added in-line to the NSK aqueous slurry at an addition rate of 5 pounds per ton by weight of dry fiber at the reel of the paper machine. A dry strength agent, carboxymethyl cellulose, (i.e., AQUALON 7 MT commercially available from Hercules Incorporated of Wilmington, Del.) was then added in-line to the NSK aqueous slurry at an addition rate of 2 pounds per ton by weight of dry fiber at the reel of the paper machine. The NSK slurry was diluted to about 0.1% consistency at the fan pump before entering the paper machine.

Eucalyptus hardwood fiber ("EUC") and water were added to a mix tank to form an aqueous slurry of about 3% by weight of dry EUC fiber. The EUC slurry was diluted to about 0.1% consistency at the fan pump before entering the paper machine.

Example II

Example II depicts a process for producing a conventionally made facial tissue incorporating the features of the present invention. Example II is represented by Tissue No. 2, in row 2 of Table I below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. A DTDMAMS based debonding agent (described above) was added to the EUC slurry in the mix tank at an addition rate of 15 pounds of DTDMAMS per ton of dry EUC fiber at the reel of the paper machine. The EUC slurry was then refined in a Sprout Waldron 12" Pressurized Refiner, model No. R12M (commercially available from Sprout Waldron Incorporated, a division of Kopper Company Incorporated of Muncy, Pa.). The EUC slurry was diluted to about 0.1% consistency at the fan pump before entering the paper machine.

Example III

Example III depicts a process for producing a conventionally made facial tissue incorporating the features of the present invention. Example III is represented by Tissue No. 3, in row 3 of Table I below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. A DTDMAMS based debonding agent (described above) was added to the EUC slurry in the mix tank at an addition rate of 15 pounds of DTDMAMS per ton of dry EUC fiber at the reel of the paper machine. The EUC slurry was then refined in a Sprout Waldron 12" Pressurized Refiner, model No. R12M. After refining, a wet strength agent, KYMENE® 557H was added in-line to the EUC slurry at an addition rate of 3 pounds per ton by weight of dry fiber at the reel of the paper machine. A dry strength agent, AQUALON 7 MT, was then added in-line to the EUC slurry at an addition rate of 1 pound per ton by weight of dry fiber at the reel of the paper machine. The EUC slurry was diluted to about 0.1% consistency at the fan pump before entering the paper machine.

Example IV

Example IV depicts a process for producing a conventionally made facial tissue incorporating the features of the present invention. Example IV is represented by Tissue No. 4, in row 4 of Table I below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 5 pounds per ton by weight of dry fiber at the reel of the paper machine. A dry strength agent, AQUALON 7 MT, was then added in-line to the NSK aqueous slurry at an addition rate of 6.5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. The EUC slurry was then refined in a Sprout Waldron 12"

Pressurized Refiner, model No. R12M. After refining, a DTDMAMS based debonding agent (described above) was added in-line to the EUC slurry at an addition rate of 15 pounds of DTDMAMS per ton of dry EUC fiber at the reel of the paper machine. A wet strength agent, KYMENE® 557H was added in-line to the EUC slurry at an addition rate of 3 pounds per ton by weight of dry fiber at the reel of the paper machine. A dry strength agent, AQUALON 7 MT, was then added in-line to the EUC slurry at an addition rate of 1 pound per ton by weight of dry fiber at the reel of the paper machine. The EUC slurry was diluted to about 0.1% consistency at the fan pump before entering the paper machine.

Paper Machine Processing and Converting of Conventionally Made Facial Tissues

The conventionally made facial tissues of Examples I–IV were all processed on the paper machine and converted according to the procedure described below.

Upon entering the paper machine, the NSK slurry was sent to the top chamber of a layering headbox while the EUC slurry was sent to the bottom layer of the layering headbox. The two slurries were then deposited onto a forming fabric in order to form a two layer tissue web (i.e.; top layer/inner layer comprised of 100% NSK and bottom layer/outer layer comprised of 100% EUC).

The layered tissue web was conventionally wet pressed and then dried and creped on a Yankee dryer to form a one-ply tissue whereby the NSK layer (i.e.; top layer/inner layer) of the tissue was facing inwardly) and the EUC layer (i.e.; bottom layer/outer layer) of the tissue was facing outwardly. This one-ply tissue was then joined to another ply of a like tissue paper, so that the NSK layers of the resulting two-ply laminate were inwardly oriented toward each other and the EUC layers (i.e.; consumer contacting layers) were outwardly facing.

Example V

Example V depicts a process for producing a through air dried facial tissue which does not incorporate the features of the present invention. Example V is represented by Tissue No. 1 (control tissue), in row 1 of Table II below.

NSK and water were added to a mix tank to form an aqueous slurry comprised of about 3% NSK by weight of dry NSK fiber.

A wet strength agent, KYMENE® 557H, was added in-line to the NSK aqueous slurry at an addition rate of 9 pounds per ton by weight of dry fiber at the reel of the paper machine. A dry strength agent, AQUALON 7 MT, was then added in-line to the NSK aqueous slurry at an addition rate of 1.5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. The EUC slurry was diluted to about 0.1% consistency at the fan pump before entering the paper machine.

Example VI

Example VI depicts a process for producing a through air dried facial tissue incorporating the features of the present invention. Example VI is represented by Tissue No. 2, in row 2 of Table II below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 9 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. A DTDMAMS based debonding agent (described above) was added to the EUC slurry in the mix tank at an addition rate of 15 pounds of DTDMAMS per ton of dry EUC fiber. The EUC slurry was diluted to about 0.1% consistency at the fan pump before entering the paper machine.

Example VII

Example VII depicts a process for producing a through air dried facial tissue incorporating the features of the present invention. Example VII is represented by Tissue No. 3, in row 3 of Table II below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 9 pounds per ton by weight of dry fiber at the reel of the paper machine. A dry strength agent, AQUALON 7 MT, was then added in-line to the NSK aqueous slurry at an addition rate of 1.5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. A DTDMAMS based debonding agent (described above) was added to the EUC slurry in the mix tank at an addition rate of 15 pounds of DTDMAMS per ton of dry EUC fiber. The EUC slurry was then refined in a Sprout Waldron 12" Pressurized Refiner, model No. R12M. The EUC slurry was diluted to about 0.1% consistency at the fan pump before entering the paper machine.

Example VIII

Example VIII depicts a process for producing a through air dried facial tissue incorporating the features of the present invention. Example VIII is represented by Tissue No. 4, in row 4 of Table II below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 9 pounds per ton by weight of dry fiber at the reel of the paper machine. A dry strength agent, AQUALON 7 MT, was then added in-line to the NSK aqueous slurry at an addition rate of 1.5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. A DTDMAMS based debonding agent (described above) was added to the EUC slurry in the mix tank at an addition rate of 15 pounds of DTDMAMS per ton of dry EUC fiber. The EUC slurry was then refined in a Sprout Waldron 12" Pressurized Refiner, model No. R12M. The EUC slurry was diluted to about 0.1% consistency at the fan pump before entering the paper machine.

Example IX

Example IX depicts a process for producing a through air dried facial tissue incorporating the features of the present invention. Example IX is represented by Tissue No. 5, in row 5 of Table II below.

NSK and water were added to a mix tank to form an aqueous slurry comprised of about 3% NSK by weight of dry NSK fiber. A wet strength agent, KYMENE® 557H, was added in-line to the NSK aqueous slurry at an addition rate of 9 pounds per ton by weight of dry fiber at the reel of the paper machine. A dry strength agent, AQUALON 7 MT, was then added in-line to the NSK aqueous slurry at an addition rate of 1.5 pounds per ton by weight of dry fiber at the reel of the paper machine. The NSK slurry was diluted to about 0.1% consistency at the fan pump before entering the paper machine.

EUC and water were added to a mix tank to form an aqueous slurry of about 3% by weight of dry EUC fiber. A DTDMAMS based debonding agent (described above) was added to the EUC slurry in the mix tank at an addition rate of 15 pounds of DTDMAMS per ton of dry EUC fiber. The EUC slurry was then refined in a Sprout Waldron 12" Pressurized Refiner, model No. R12M. The EUC slurry was diluted to about 0.1% consistency at the fan pump before entering the paper machine.

Paper Machine Processing and Converting of Through Air Dried Facial Tissues

The through air dried facial tissues of Examples V–IX were all processed on the paper machine and converted according to the procedure described below.

Upon entering the paper machine, the NSK slurry was sent to the top chamber of a layering headbox while the EUC slurry was sent to the bottom layer of the layering headbox. The two slurries were then deposited onto a forming fabric in order to form a two layer tissue web (i.e.; top layer/inner layer comprised of 100% NSK and bottom layer/outer layer comprised of 100% EUC).

The layered tissue web was through air dried and then further dried and creped on a Yankee dryer to form a one-ply tissue whereby the NSK layer (i.e.; top layer/inner layer of the tissue) was facing inwardly) and the EUC layer (i.e.; bottom layer/outer layer/consumer-contacting layer) of the tissue was facing outwardly. This one-ply tissue was then joined to another ply of a like tissue paper, so that the NSK layers of the resulting two-ply laminate were inwardly oriented toward each other and the EUC layers (i.e.; consumer contacting layers) were outwardly facing.

TABLE I

CONVENTIONALLY MADE TISSUE

| 1 TEST CONDITION No. | 2 TOTAL FURNISH COMP. | 3 APPROX. CSF EUC LAYER PRIOR TO REFINING (i.e.; BASELINE FREENESS) (CSF UNITS) | 4 APPROX. CSF EUC LAYER AFTER REFINING (CSF UNITS) | 5 DEBOND. ADD'N TO EUC (LBS/T) | 6 EUC DEBOND. ADD'N POINT | 7 WET STRENGTH ADD'N TO EUC (LBS/T) | 8 WET STRENGTH ADD'N POINT TO EUC | 9 DRY STRENGTH TO EUC (LBS/T) |
|---|---|---|---|---|---|---|---|---|
| 1 (Control) | 60% EUC 40% NSK | 635 | NR | 0 | NA | 0 | 0 | 0 |
| 2 | 50% EUC 50% NSK | 635 | 528 | 15 | Mix Tank | 0 | NA | 0 |
| 3 | 50% EUC 50% NSK | 635 | 505 | 15 | Mix Tank | 3 | In-line | 1 |
| 4 | 50% EUC 50% NSK | 635 | 602 | 15 | In-line | 3 | In-line | 1 |

| 1 TEST CONDITION No. | 10 DRY STRENGTH ADD'N POINT TO EUC | 11 WET STRENGTH ADD'N TO NSK (LBS/T) | 12 WET STRENGTH ADD'N POINT TO NSK | 13 DRY STRENGTH ADD'N TO NSK (LBS/T) | 14 DRY STRENGTH ADD'N POINT TO NSK |
|---|---|---|---|---|---|
| 1 (Control) | 0 | 5 | In-line | 2 | In-line |
| 2 | NA | 5 | In-line | 0 | NA |
| 3 | In-line | 5 | In-line | 0 | NA |
| 4 | In-line | 5 | In-line | 6.5 | In-line |

| 15 TEST CONDITION No. | 16 No. PLIES | 17 No. LAYERS PER PLY | 18 APPROX. AVERAGE TISSUE TENSILE STRENGTH N = 3 | 19 AVERAGE TISSUE SOFTNESS N = 16 | 20 TISSUE OUTER LAYER (i.e.; EUC LAYER) LINT N = 3 |
|---|---|---|---|---|---|
| 1 (Control) | 2 | 2 | 611 | 0 | 7.7 |
| 2 | 2 | 2 | 648 | 1.3 | 8.8 |

TABLE I-continued

| CONVENTIONALLY MADE TISSUE | | | | | |
|---|---|---|---|---|---|
| 3 | 2 | 2 | 810 | 0.9 | 6.7 |
| 4 | 2 | 2 | 550 | 3.0 | 7.1 |

NOTES:
All tissues shown are comprised of the same layer composition (i.e.; inner layer is 100% NSK, outer layer is 100% Eucalyptus).
NR = Not Refined
NA = Not Applicable
No debonding agent added to NSK layer.
The NSK layer was not refined.

TABLE II

THROUGH AIR DRIED TISSUE

| 1 TEST CONDITION No. | 2 TOTAL FURNISH COMP. | 3 APPROX CSF EUC LAYER PRIOR TO REFINING (CSF UNITS) | 4 APPROX. CSF EUC LAYER AFTER REFINING (CSF UNITS) | 5 DEBOND. ADD'N TO EUC (LBS/T) | 6 EUC DEBOND. ADD'N POINT | 7 WET STRENGTH ADD'N TO EUC (LBS/T) | 8 WET STRENGTH ADD'N POINT TO EUC | 9 DRY STRENGTH ADD'N TO EUC (LBS/T) |
|---|---|---|---|---|---|---|---|---|
| 1 (Control) | 40% EUC 60% NSK | 635 | NR | 0 | NA | 0 | NA | 0 |
| 2 | 50% EUC 50% NSK | 635 | NR | 15 | Mix Tank | 0 | NA | 0 |
| 3 | 50% EUC 50% NSK | 635 | 605 | 15 | Mix Tank | 0 | NA | 0 |
| 4 | 50% EUC 50% NSK | 635 | 433 | 15 | Mix Tank | 0 | NA | 0 |
| 5 | 50% EUC 50% NSK | 635 | 331 | 15 | Mix Tank | 0 | NA | 0 |

| 1 TEST CONDITION No. | 10 DRY STRENGTH ADD'N POINT TO EUC | 11 WET STRENGTH ADD'N TO NSK (LBS/T) | 12 WET STRENGTH ADD'N POINT TO NSK | 13 DRY STRENGTH ADD'N TO NSK (LBS/T) | 14 DRY STRENGTH ADD'N TO NSK |
|---|---|---|---|---|---|
| 1 (Control) | NA | 9 | In-line | 1.5 | In-line |
| 2 | NA | 9 | In-line | 0 | NA |
| 3 | NA | 9 | In-line | 1.5 | In-line |
| 4 | NA | 9 | In-line | 1.5 | In-line |
| 5 | NA | 9 | In-line | 1.5 | In-line |

| 15 TEST CONDITION No. | 16 No. PLIES | 17 No. LAYERS PER PLY | 18 APPROX. AVERAGE TISSUE TENSILE STRENGTH N = 3 (grams/in.) | 19 AVERAGE TISSUE SOFTNESS N = 20 (PSU) | 20 AVERAGE TISSUE OUTER LAYER (i.e.; EUC LAYER) LINT N = 3 (L value) |
|---|---|---|---|---|---|
| 1 (Control) | 2 | 2 | 761 | −0.15 | 6.9 |
| 2 | 2 | 2 | 526 | 1.36 | 10.8 |
| 3 | 2 | 2 | 625 | 0.53 | 6.7 |
| 4 | 2 | 2 | 638 | 0.01 | 3.0 |
| 5 | 2 | 2 | 699 | −0.33 | 1.0 |

NOTES:
NR = Not Refined
NA = Not Applicable
All tissues shown are comprised of the same layer composition (i.e.; inner layer is 100% NSK, outer layer is 100% Eucalyptus).
No debonding agent added to NSK layer.
The NSK layer was not refined.

While particular embodiments of the present invention are illustrated and described herein, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for making soft tissue, said process comprising:

(a) providing an aqueous slurry of papermaking fibers;

(b) debonding said papermaking fibers with a debonding agent wherein said debonding agent is added to said papermaking fibers in an amount from about 13 pounds per ton to 30 pounds per ton of said debonding agent by weight of dry papermaking fibers;

(c) mechanically treating said debonded papermaking fibers so that the Canadian Standard Freeness after mechanical treatment is at least about 1.5% less than the Canadian Standard Freeness prior to mechanical treatment;

(d) forming a tissue web; and (e) drying said tissue web.

2. The process according to claim 1 wherein said debonding agent is a quaternary ammonium compound or a tertiary amine.

3. The process according to claim 2 wherein said quaternary ammonium compound has the formula:

$$(R_1)_{4-m}—N^+—[R_2]_mX^-$$

wherein m is 1 to 3;

each $R_1$ is a $C_1$–$C_8$ alkyl group, hydroxyalkyl group, hydrocarbyl or substituted hydrocarbyl group, alkoxylated group, benzyl group, or mixtures thereof;

each $R_2$ is a $C_9$–$C_{41}$ alkyl group, hydroxyalkyl group, hydrocarbyl or substituted hydrocarbyl group, alkoxylated group, benzyl group, or mixtures thereof; and $X^-$ is any softener-compatible anion.

4. The process according to claim 3 wherein said quaternary ammonium compound is a dialkyldimethylammonium salt.

5. The process according to claim 4 wherein said dialkyldimethylammonium salt is dialkyldimethylammonium chloride, ditallowdimethylammonium methyl sulfate, di(hydrogenated)tallow dimethyl ammonium chloride, or mixtures thereof.

6. The process according to claim 2 wherein said quaternary ammonium compound is a biodegradable ester-functional quaternary ammonium compound having the formula:

$$(R)_{4-m}—N^+—[(CH_2)_n—Y—R_2]_mX^-$$

wherein each Y=—O—(O)C—, or —C(O)—O—;

m=1 to 3;

each n=1 to 4;

each R substituent is a short chain $C_1$–$C_6$ alkyl group, hydroxyalkyl group, hydrocarbyl group, benzyl group or mixtures thereof; each $R_2$ is a long chain, $C_{11}$–$C_{23}$ hydrocarbyl, or substituted hydrocarbyl substituent and $X^-$ is any softener-compatible anion.

7. The process according to claim 1 wherein said papermaking fibers are hardwood fibers.

8. The process according to claim 7 wherein said hardwood fibers are eucalyptus fibers.

9. The process according to claim 1 furthering comprising adding an optional wet strength agent wherein the addition rate of said wet strength agent to said papermaking fibers is from about 0.1 pound per ton to 60 pounds per ton of said wet strength agent based on the weight of dry papermaking fibers.

10. The process according to claim 1 further comprising adding an optional dry strength agent wherein the addition rate of said dry strength agent to said papermaking fibers is from about 0.1 pound per ton to 60 pounds per ton of said dry strength agent based on the weight of dry papermaking fibers.

11. The process according to claim 10 wherein said dry strength agent is carboxymethylcellulose.

12. The process according to claim 1 wherein said tissue web is through air dried.

13. The process according to claim 1 wherein said tissue web is layered.

14. The process according to claim 13 wherein said tissue web includes at least one outer layer comprised of at least about 30% hardwood fibers.

15. A process for making soft tissue, said process comprising:

(a) providing an aqueous slurry of papermaking fibers;

(b) mechanically treating said papermaking fibers so that the Canadian Standard Freeness after mechanical treatment is at least about 1.5% less than the Canadian Standard Freeness prior to mechanical treatment;

(c) debonding said papermaking fibers with a debonding agent wherein said debonding agent is added to said papermaking fibers in an amount from about 13 pounds per ton to 20 pounds per ton of said debonding agent by weight of dry papermaking fibers;

(d) forming a tissue web; and (e) drying said tissue web.

16. The process according to claim 15 wherein said tissue web is comprised of one or more inner layers of fiber and one or more outer layers of fiber whereby at least one of said outer layers of fiber is comprised of at least about 30% debonded hardwood fiber.

17. The process according to claim 16 wherein at least one of said outer layers of fiber is comprised of at least about 50% debonded hardwood fiber.

18. The process according to claim 17 wherein at least one of said outer layers of fiber is comprised of at least about 70% debonded hardwood fiber.

19. The process according to claim 18 wherein at least one of said outer layers of fiber is comprised of about 100% debonded hardwood fiber.

20. A process for making soft tissue, said process comprising:

(a) providing an aqueous slurry of hardwood papermaking fibers;

(b) debonding said hardwood papermaking fibers with a debonding agent wherein said debonding agent is added to said hardwood papermaking fibers in an amount from about 13 pounds per ton to 30 pounds per ton of said debonding agent by weight of dry hardwood papermaking fibers;

(c) refining said debonded hardwood papermaking fibers so that the Canadian Standard Freeness after refining is at least about 1.5% less than the Canadian Standard Freeness prior to refining;

(d) forming a tissue web comprised of an outer layer and an inner layer, wherein said outer layer of said tissue web is composed of said debonded and refined hardwood fiber; and (e) drying said tissue web.

* * * * *

UNITED STATES PATENT AND TRADEMARK OFFICE

CERTIFICATE OF CORRECTION

PATENT NO. : 6,241,850 B1
DATED : June 5, 2001
INVENTOR(S) : Stephen Robert Kelly It is certified that error appears in the above-identified patent and that said Letters Patent is hereby corrected as shown below:

Title page,
Item [57], ABSTRACT,
Line 2, “limiting” should read -- linting --.

Column 7,
Line 67, “quaterrauy” should read -- quaternary --.

Column 17,
Line 6, “staring” should read -- starting --.

Signed and Sealed this

Tenth Day of September, 2002

*Attest:*

*Attesting Officer*

JAMES E. ROGAN
*Director of the United States Patent and Trademark Office*